US006719021B1

(12) United States Patent
Jwu

(10) Patent No.: US 6,719,021 B1
(45) Date of Patent: Apr. 13, 2004

(54) FUNNEL WITH LIQUID LEVEL INDEX

(76) Inventor: Fu-Yi Jwu, 2Fl., No. 3, Lane 155, Duenhua N. Rd., Taipei (TW)

( * ) Notice: Subject to any disclaimer, the term of this patent is extended or adjusted under 35 U.S.C. 154(b) by 9 days.

(21) Appl. No.: 10/321,484

(22) Filed: Dec. 18, 2002

(51) Int. Cl.[7] ..... B65B 1/04
(52) U.S. Cl. ..... 141/331; 141/199
(58) Field of Search ..... 141/94, 95, 199, 141/331–345

(56) References Cited

U.S. PATENT DOCUMENTS 42,684 A * 5/1864 Otis ..... 141/94
823,932 A * 6/1906 Corcoran ..... 141/94
1,333,756 A * 3/1920 Heimgartner ..... 141/95

* cited by examiner

*Primary Examiner*—Steven O. Douglas
(74) *Attorney, Agent, or Firm*—Dennison, Schultz & Dougherty

(57) ABSTRACT

A funnel with a liquid level index is provided beneath the neck thereof with a plurality of extension rods, and a plurality of openings are formed between every two extension rods; an indicator with a floating member and an upper shank is provided under the neck within the extension rods. The indicator is provided on the top end thereof with an easy identified index; thereby, when the funnel is added with solution-up to a level fully filling a container, the bottom floating member of the indicator is raised to move the index on the indicator; by raising of the index, a user determines whether the container is fully filled with liquid or determines the degree of fullness of liquid.

3 Claims, 6 Drawing Sheets

FUNNEL WITH LIQUID LEVEL INDEX

BACKGROUND OF THE INVENTION

1. Field of the Invention

The present invention is related to a funnel with a liquid level index, and especially to such a funnel which makes easy recognition of the degree of fullness of a container added with liquid to prevent the liquid from spilling out of the container, the funnel is suitable for application to those non-transparent containers such as a battery added with liquid (diluted sulfuric acid solution) or the like unable to be observed on the liquid level.

2. Description of the Prior Art

When it is to divide and load solution from a larger package into smaller containers for convenient carrying, the most often seen way is to distribute the solution with a funnel. When the smaller containers are transparent, the process of distribution is quite simple, it needs only to observe the levels of the liquid in the smaller containers; however, if the smaller containers are non-transparent, the liquid levels therein are unable to see, hence the distributed solution will spill out of the containers.

In adding the battery liquid for a car, whenever the battery liquid is consumed and requires to be supplemented, by virtue that the battery of the car is non-transparent, the user can only put a funnel at the liquid inlet port of the battery for supplementation of battery liquid. The battery liquid is poured in slowly, then the funnel is displaced to observe the inlet port of a small diameter; this method is uneasy to distinguish and recognize the liquid level, when the liquid is poured too fast or too violent, the corrosive battery liquid is subject to spilling out. The structure of the battery itself has corrosion resistance, thereby the battery liquid will not influence the battery no matter it is in or out of the battery; however, the rest structural members of the car do not have corrosion resistance, the spilling battery liquid will corrode them and destruct the car structure, thereby this is not desired.

In view that the above stated defects in the conventional funnel structure are supposed to be eliminated, the motive of the present invention is to study and provide a funnel with simple components, convenient for use and with a liquid level index for use by customers.

SUMMARY OF THE INVENTION

The primary object of the present invention is to provide a funnel with a liquid level index, in order that when in dividing and loading or adding solution in an non-transparent container, it can be easily recognized whether the non-transparent container has been fully filled with liquid or has reached the degree of fullness.

The secondary object of the present invention is to provide a funnel with a liquid level index, with which when in adding solution in a container nearly to the fullness, the speed of the solution flowing into the container can be reduced.

To achieve the above stated objects, in the funnel with a liquid level index of the present invention, the funnel is provided beneath the neck thereof with a plurality of extension rods, and a plurality of openings are formed between every two extension rods; an indicator with a floating member is provided under the neck within the extension rods, and a bottom annulus is integrally formed on the bottom ends of the extension rods. The indicator is movably located between the bottom annulus and the neck, and has a shank connecting on the top end of the floating member; the shank is provided on the upper end thereof with an index easy for recognition. Thereby, when the funnel is added with solution up to a level fully filling the container, the bottom floating member of the indicator is raised to move the index of the indicator; by raising of the index, a user can determine whether the container is fully filled with liquid or determine the degree of fullness.

The present invention will be apparent in its features after reading the detailed description of the preferred embodiment thereof in reference to the accompanying drawings.

DETAILED DESCRIPTION OF THE PREFERRED EMBODIMENT

Figure 1:
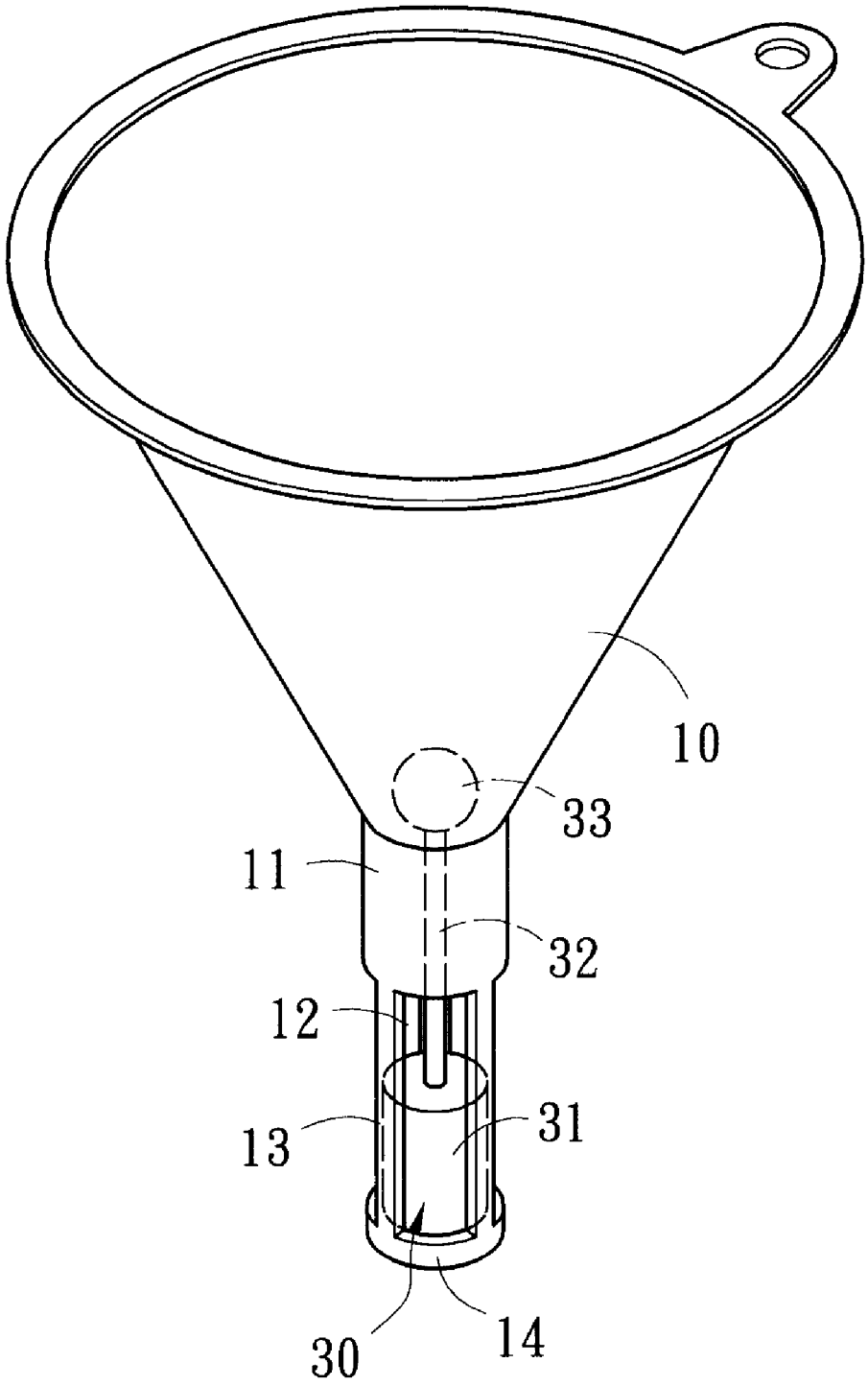
FIG. 1 is a perspective schematic view showing the elements of the first embodiment in the present invention.

Referring simultaneously to FIGS. 1, 2, 2*a* and 3, the funnel with a liquid level index of the present invention has a conical main body 10 of which the bottom end forms a neck 11, the inner surface of the main body 10 has near the bottom end thereof a marking line 16, the neck 11 is provided therebeneath with a plurality of extension rods 13, and a plurality of openings 12 are formed between every two extension rods 13; and a bottom annulus 14 is integrally formed on the bottom ends of the extension rods 13. The bottom annulus 14 is provided on the inner surface thereof with a plurality of protrusions 15.

An indicator 30 composing of a floating member 31 and a shank 32 is provided, the shank 32 is provided on one end thereof with an index 33, and is connected on the other end with a floating member 31 of which the external diameter is larger than the inner diameter of the neck 11 of the main body 10.

Figure 2:
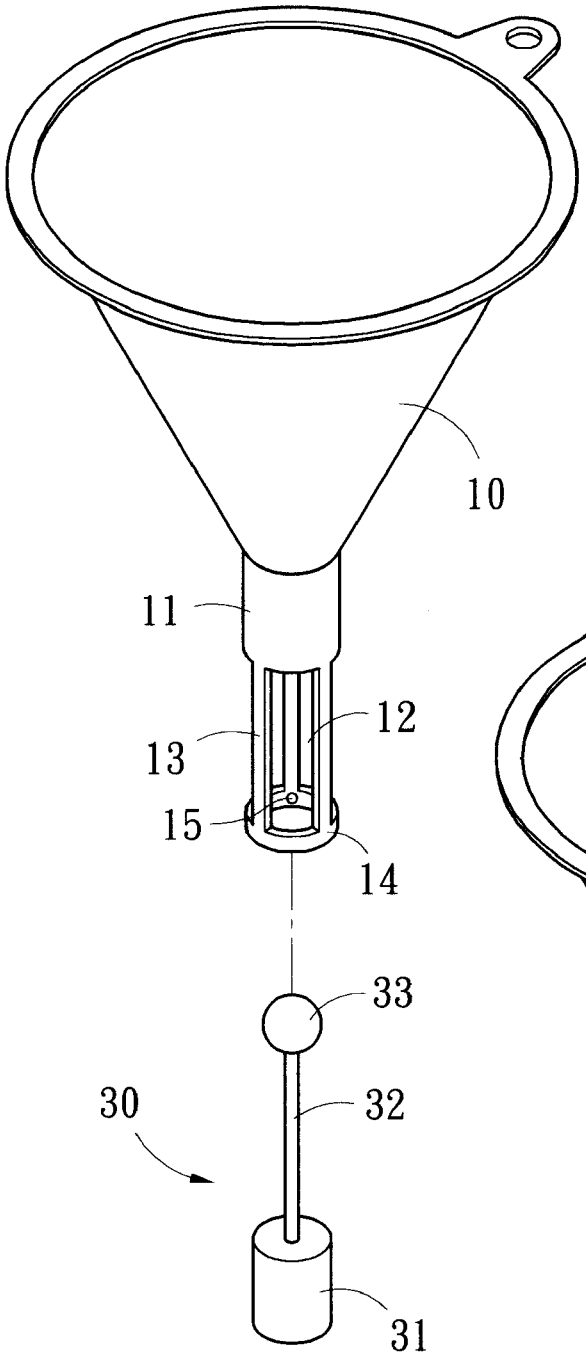
FIG. 2 is an analytic perspective view showing the elements of the first embodiment in the present invention.
Figure 2A:
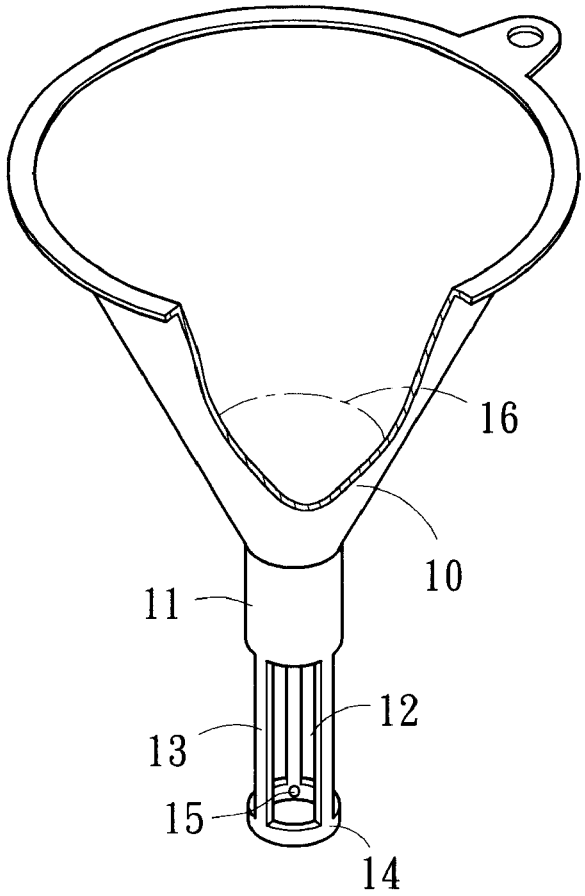
FIG. 2*a* is a partially exploded perspective view showing the first embodiment of the funnel of the present invention.
Figure 3:
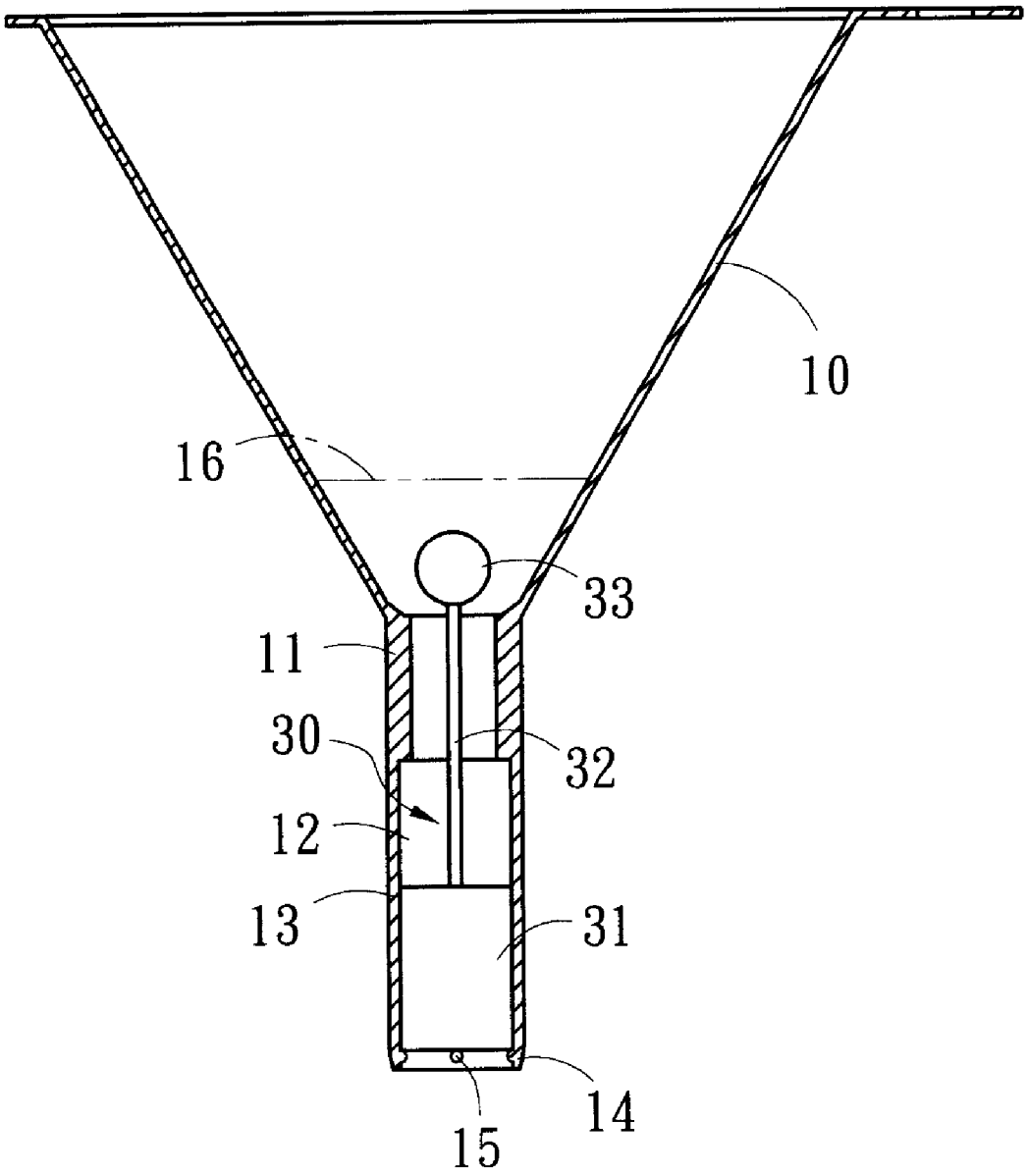
FIG. 3 is a sectional view showing the combination of the first embodiment of the funnel of the present invention.

Referring to FIGS. 1 and 2, when in assembling, the indicator 30 is inserted upwardly from below between the neck 11 and the bottom annulus 14. The bottom annulus 14 or the floating member 31 is elastic, thereby, the indicator 30 can be forcedly inserted upwardly from below to a position above the bottom annulus 14; the space formed by the extension rods 13 allows the protrusions 15 on the inner wall of the bottom annulus 14 to abut against the bottom end of the floating member 31, so that the indicator 30 can be movably located within the space formed by the extension rods 13 and between the bottom annulus 14 and the neck 11 without dropping down.

Figure 4:
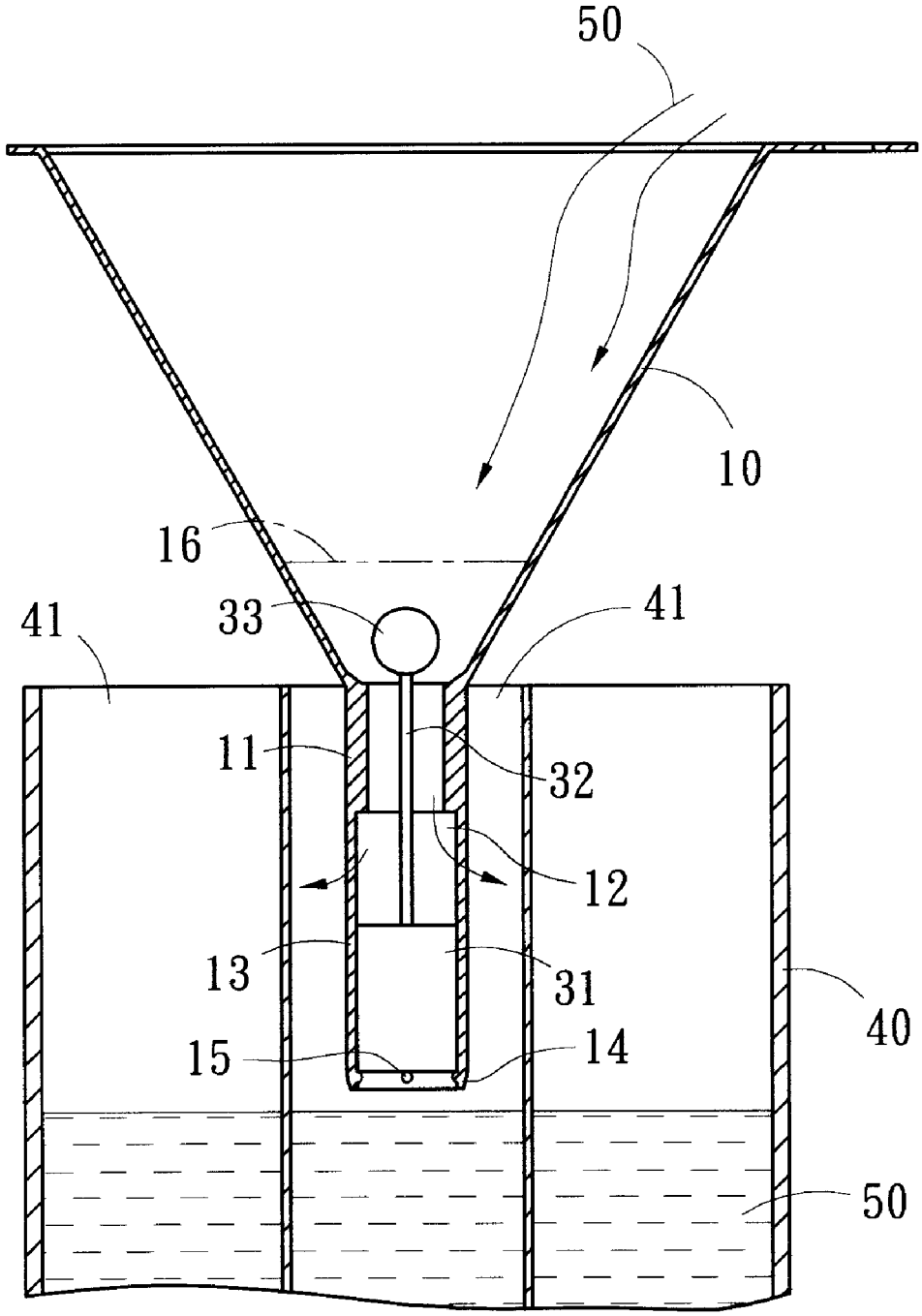
FIGS. 4–5 are sectional schematic views showing use of the first embodiment of the funnel of the present invention.

The way of using of the present invention is same as that of a conventional funnel; referring to FIG. 4, taking car battery liquid 50 added as an example, the neck 11 of the main body 10 is placed downwardly in the liquid accessing port 41, when the level of the car battery liquid 50 is low, the bottom edge of the floating member 31 of the indicator 30 will be abutted against the protrusions 15 of the bottom annulus 14, the index 33 on the top end of the shank 32 is located at near the bottom of the main body 10, and three openings 12 beneath the neck 11 of the main body 10 form three outfalls. When the car battery liquid 50 is poured into the main body 10 of the funnel, the car battery liquid 50 flows into a battery 40 along the main body 10, the neck 11 and through the openings 12. When the battery liquid 50 supplied is to be full in the battery 40, and the liquid level rises as shown in FIG. 5, the floating member 31 of the indicator 30 within the extension rods 13 beneath the neck 11 will float on the liquid surface, and the shank 32 connected on the top thereof will rise too, and the index 33 on the end of the shank 32 reaches the marking line 16 on the main body 10 of the funnel, the user hence can easily find that the container is fully added, this can prevent the battery liquid 50 from spilling out of the battery 40 to corrode the car body.

Figure 5:
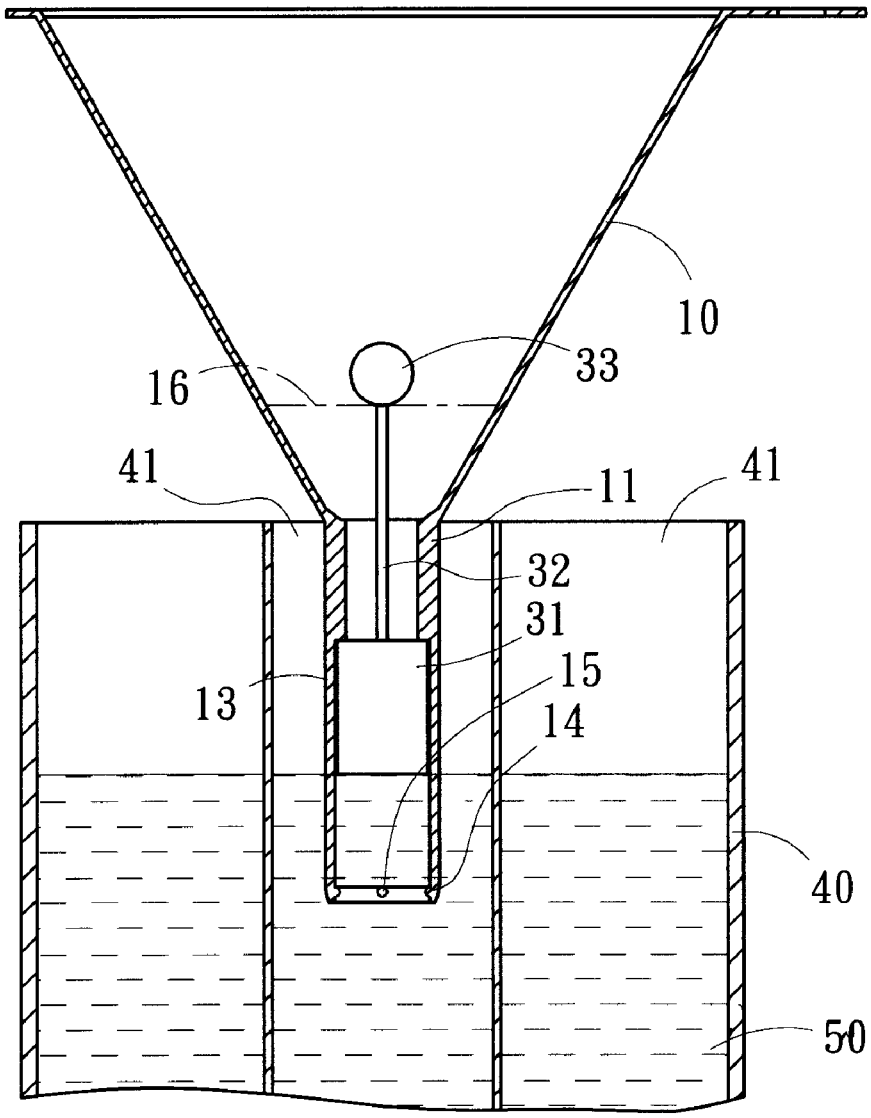

And as shown in FIG. 5, when the floating member 31 of the indicator 30 rises, it can block the bottom end of the neck 11 of the main body 10, thereby, the liquid in the funnel can flow down into the battery 40 with a slowed down speed, and even can stop.

Figure 6:
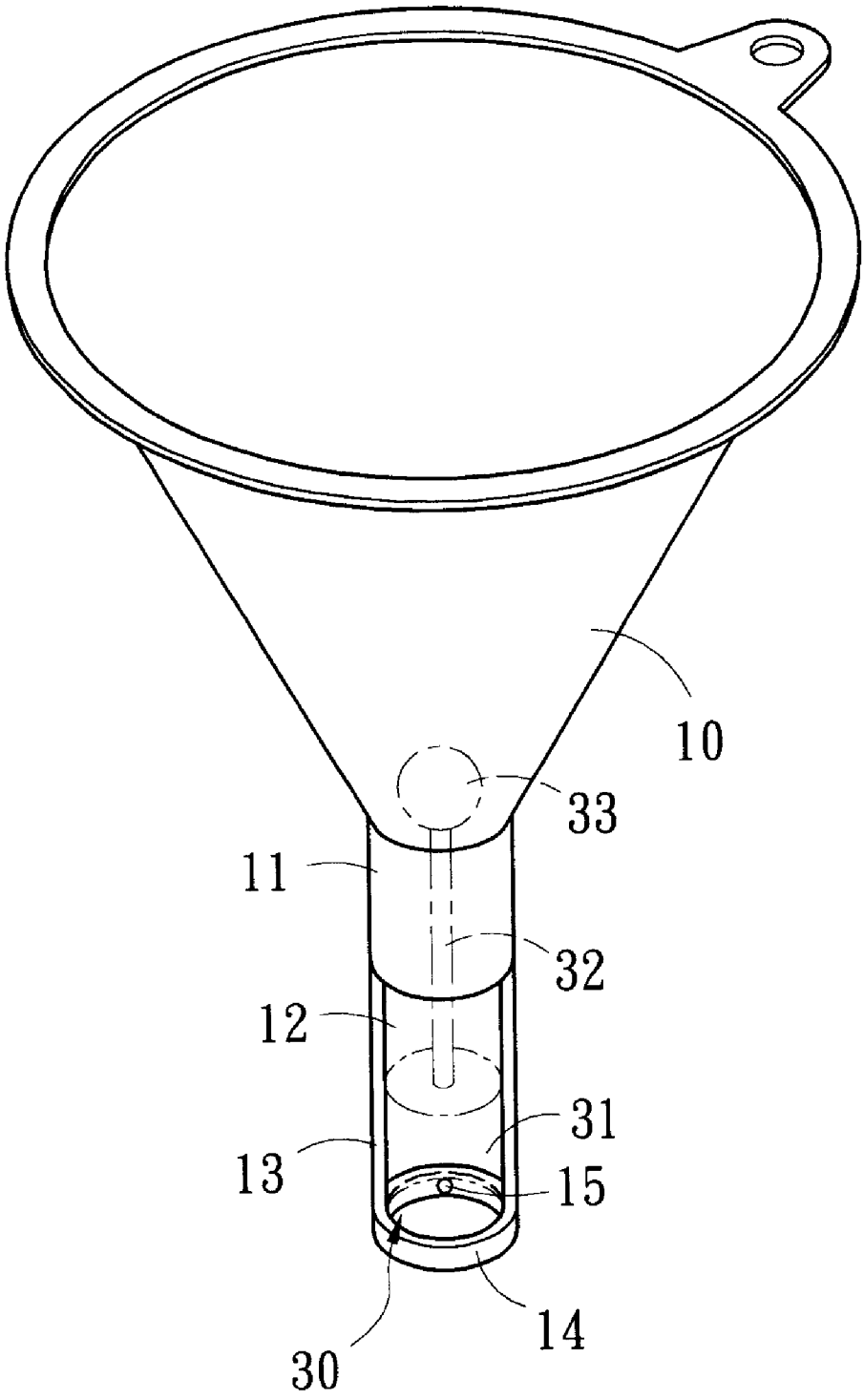
FIG. 6 is a perspective view showing the appearance of the second embodiment of the present invention.

And as shown in FIG. 6 depicting the second embodiment of the present invention, the neck 11 has therebeneath two mutually opposite extension rods 13 and two corresponding openings 12, this can also get the same effect as that of the foregoing embodiment.

From the above statement, the structure of the present invention has the following practical advantages:

1. With the simple components, in using the present invention on a non-transparent container, the liquid level in the container can be recognized and determined.
2. The way of using of the present invention is same as that of a conventional funnel, but the effect that the present invention can get is improved.
3. If the divided and loaded solution is danger by being corrosive or erosive, with the simple components of the present invention, the solution is prevented from spilling out of the container, so that the car body and articles of the car will not be damaged, this can further show the effectiveness of the present invention.

The above stated is only for illustrating preferred embodiments of the present invention, and not for giving any limitation to the scope of the present invention. It will be apparent to those skilled in this art that various modifications or changes can be made to the elements of the present invention and also fall within the scope of the appended claims and are intended to form part of this invention.

In conclusion, from the above stated contents, the present invention can surely get its expected objects to provide a funnel with a liquid level index which is practicable.

I claim:

1. The funnel with a liquid level index comprising:

a main body of which the bottom end forms a neck, said main body is provided beneath said neck with a plurality of extension rods, and a plurality of openings are formed between every two of said extension rods; and a bottom annulus is integrally formed on the bottom ends of said extension rods, said bottom annulus is provided on the inner surface thereof with a plurality of protrusions; and an indicator with a floating member and an upper shank provided on the top end thereof with an index, said floating member is located between said bottom annulus and said neck, said index on the top end of said shank protruding upwardly above said neck;

thereby, when said funnel is added with solution up to a level fully filling a container, said bottom floating member of said indicator is raised to move said index of said indicator; by raising of said index of said indicator, a user determines whether said container is fully filled with liquid or determines the degree of fullness of liquid, and wherein, the external diameter of said floating member is larger than the inner diameter of said neck of said main body, thereby when in adding solution in said container nearly to the fullness, said floating member rises to block said neck of said main body, thereby, the speed of said solution flowing into said container is reduced.

2. The funnel with a liquid level index as in claim 1, wherein, the inner surface of said main body of said funnel has near the bottom end thereof a marking line.

3. The funnel with a liquid level index as in claim 1, wherein, the height of said openings provided beneath said neck of said main body of said funnel is larger than that of said neck of said main body of said funnel.

* * * * *